US007460799B2

(12) United States Patent
Yamaguchi

(10) Patent No.: US 7,460,799 B2
(45) Date of Patent: Dec. 2, 2008

(54) DEVELOPER ACCOMMODATING APPARATUS, DEVELOPING APPARATUS AND IMAGE FORMING APPARATUS

(75) Inventor: Yasunaga Yamaguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/525,086

(22) Filed: Sep. 22, 2006

(65) Prior Publication Data

US 2007/0071464 A1 Mar. 29, 2007

(30) Foreign Application Priority Data

Sep. 27, 2005 (JP) ..... 2005-279199

(51) Int. Cl.
*G03G 15/08* (2006.01)

(52) U.S. Cl. ..... 399/27; 399/64

(58) Field of Classification Search ..... 399/27, 399/64

See application file for complete search history.

(56) References Cited

U.S. PATENT DOCUMENTS 5,036,358 A * 7/1991 Yoshida ..... 399/64
5,499,077 A * 3/1996 Endo et al. ..... 399/27
5,532,790 A * 7/1996 Akazawa ..... 399/64
5,557,368 A * 9/1996 Endo et al. ..... 399/27
5,587,770 A * 12/1996 Jo et al. ..... 399/27
5,655,175 A * 8/1997 Oshida ..... 399/27
5,682,574 A * 10/1997 Oshida et al. ..... 399/64
6,061,535 A * 5/2000 Yokomori et al. ..... 399/61
7,162,174 B2 * 1/2007 Suzuki et al. ..... 399/64
2001/0021314 A1 * 9/2001 Hibi ..... 399/27
2006/0188273 A1 * 8/2006 Takesawa et al. ..... 399/27
2006/0193643 A1 * 8/2006 Takagi et al. ..... 399/12

FOREIGN PATENT DOCUMENTS

JP 2002-311701 10/2002

* cited by examiner

*Primary Examiner*—David M. Gray
*Assistant Examiner*—Kristofferson Service
(74) *Attorney, Agent, or Firm*—Rabin & Berdo, PC

(57) ABSTRACT

A developer accommodating apparatus, a developing apparatus and an image forming apparatus are provided capable of obtaining detection stability of irregular reflection light. The developing apparatus of the present invention comprises an accommodating section to accommodate developer of predetermined quantity, a light emitting section to emit light toward outside; and a light shading section to shade the light emitted from the light emitting section according to the predetermined quantity of the developer in the accommodating section.

17 Claims, 14 Drawing Sheets

DEVELOPER ACCOMMODATING APPARATUS, DEVELOPING APPARATUS AND IMAGE FORMING APPARATUS

BACKGROUND OF THE INVENTION

1. Field of the Invention

The invention relates to printer, specially relates to a developer accommodating apparatus, a developing apparatus and an image forming apparatus of electrophotography type.

2. Related Background Art

Conventionally, in a developer accommodating apparatus, a developing apparatus and an image forming apparatus of electrophotography type, there is a need to detect a remainder quantity of toner filled in the developing apparatus or in the developer accommodating apparatus, that is installed attachably and removably onto the image forming apparatus. Such technology is disclosed by patent document 1.

Then, a past example is known which furnishes a toner stirring section into the developing apparatus, and in a cycle of rotation operation of the stirring section, makes a duty ratio of time stagnating at a specific operation point according to a difference of toner remainder quantity change, and changes the duty ratio into a toner remainder quantity.

As a means to detect the operation of such stirring section, it is realized through irradiating light from a light emitting element provided in apparatus substance on a reflection board synchronously with a rotation motion cycle of the stirring section, then receiving reflection light formed by the reflection board through using a light receiving element provided in apparatus substance, and detecting a duty ratio.

On a toner cartridge, a light penetrating window is furnished. Then, to synchronizing with a rotation motion cycle of the stirring section, a light signal from the light emitting element penetrates the light penetrating window. As a result, because a light route till the light emitting element is detected as a duty ratio, the toner remainder quantity is converted.

Patent document 1: Japan patent publication 2002-311701.

However, in the above-stated conventional developer accommodating apparatus, developing apparatus and image forming apparatus, because there is a need to long secure the light route, and a light quantity attenuates due to the reflection means and the long light route, so it is necessary to more secure the light emission quantity of the light emitting element.

When the light emission quantity becomes much, a diffused reflection having no intention increases. In order to reduce the diffused reflection, a stable optical axis needs to be provided. But, it is so much difficult to meet a detection stability of diffused reflection light.

SUMMARY OF THE INVENTION

It is, therefore, an object of the invention to provide a developer accommodating apparatus, a developing apparatus and an image forming apparatus capable of solving the above problem and obtaining a detection stability of irregular reflection light.

According to the present invention, there is provided an developing apparatus having an accommodating section to accommodate developer, comprising a light emitting section to emit light toward the outside of the developing apparatus; and a light shading section to shade the light emitted from the light emitting section according to a quantity of the developer in the accommodating section.

Further, according to the present invention, there is provided an image forming apparatus, comprising a developing apparatus having an accommodating section to accommodate developer; a light receiving section; and a developer quantity detecting section, wherein the developing apparatus includes a light emitting section to emit light toward the outside of the developing apparatus; and a light shading section to shade the light emitted from the light emitting section according to a quantity of the developer in the accommodating section; the light receiving section receives the light emitted from the light emitting section; and the developer quantity detecting section detects the quantity of the developer in the accommodating section on the basis of the light received by the light receiving section.

Furthermore, according to the present invention, there is provided an developer accommodating apparatus having an accommodating section to accommodate developer, comprising a light emitting section to emit light toward outside; and a light shading section to shade the light emitted from the light emitting section according to a quantity of the developer in the accommodating section.

According to the developer accommodating apparatus, the developing apparatus and the image forming apparatus of the present invention, such effect can be obtained. That is, it is possible to obtain a detection stability of irregular reflection light.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

Next is to explain an embodiment 1 as a best form for executing the present invention with using drawing.

Figure 1:
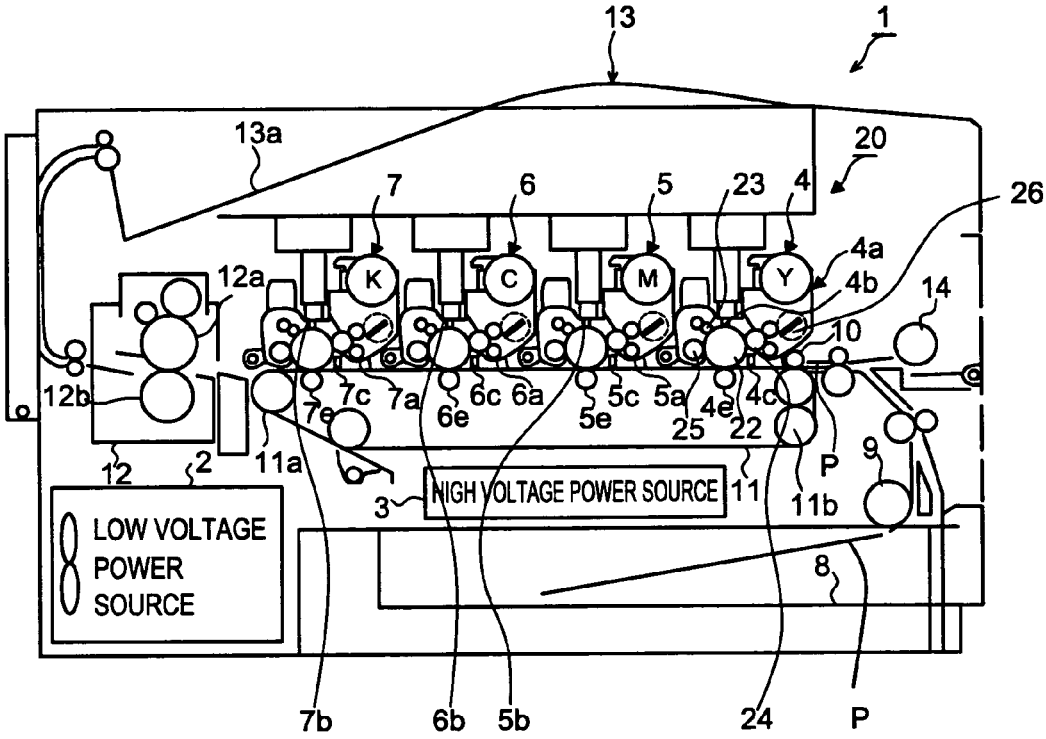
FIG. 1 is a vertical section diagram showing a printing apparatus substance relative to a developer accommodating apparatus, a developing apparatus and an image forming apparatus in embodiment 1 of the present invention.
Figure 2:
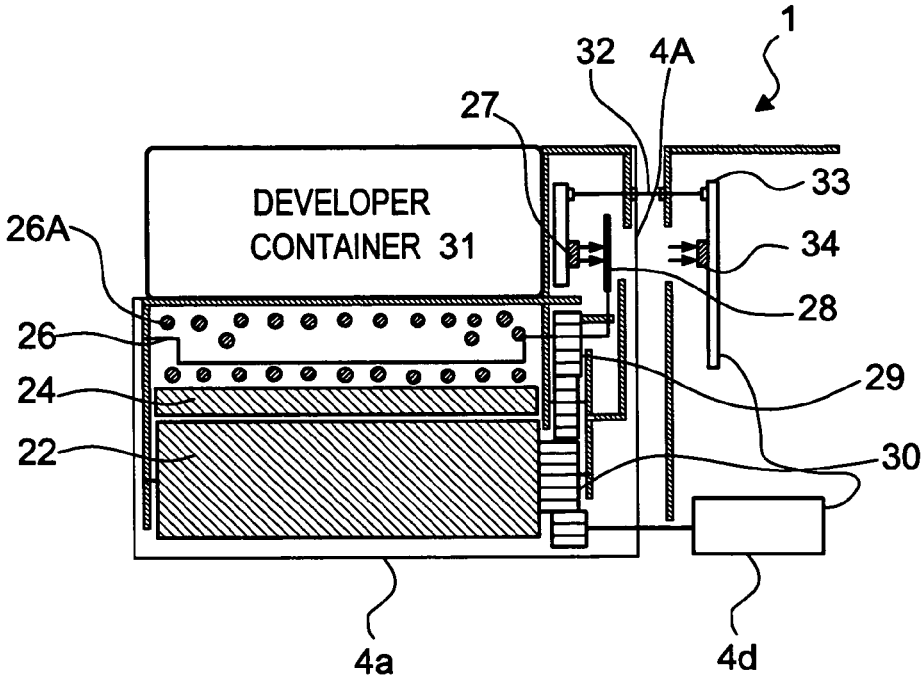
FIG. 2 is a vertical section diagram showing a structure of circumstance of a developing apparatus in FIG. 1.
Figure 3:
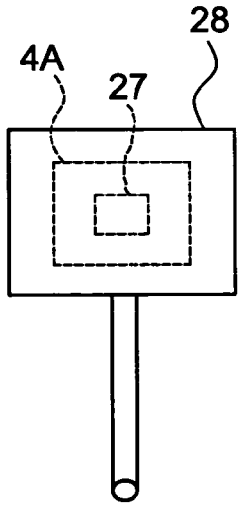
FIG. 3 is a diagram showing a shape of a light shading section 28 in FIG. 2.
Figure 4:
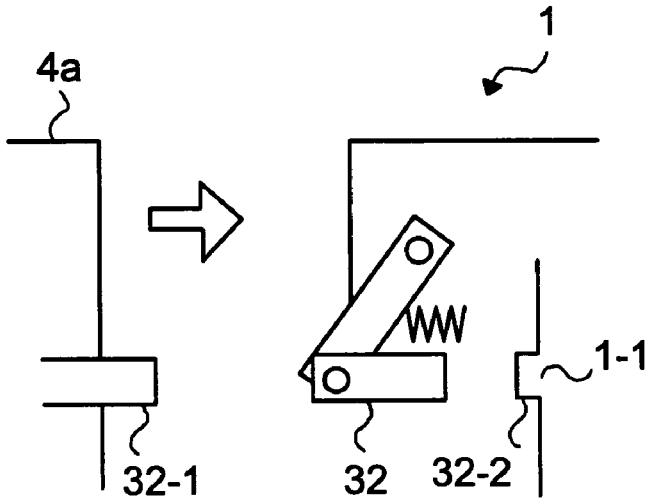
FIG. 4 is a diagram showing a state before connecting a developing apparatus to a printing apparatus substance.
Figure 5:
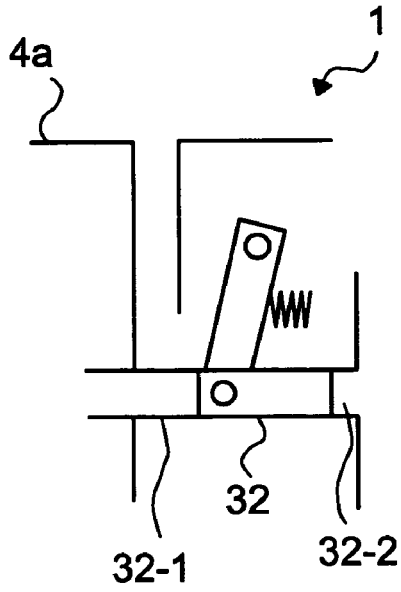
FIG. 5 is a diagram showing a connection state of a connection part.

FIG. 1 is a vertical section diagram showing a printing apparatus substance relative to a developer accommodating apparatus, a developing apparatus and an image forming apparatus in embodiment 1 of the present invention; FIG. 2 is a vertical section diagram showing a structure of circumstance of a developing apparatus in FIG. 1; FIG. 3 is a diagram showing a shape of a light shading section 28 in FIG. 2; FIG. 4 is a diagram showing a state before connecting a developing apparatus to a printing apparatus substance; and FIG. 5 is a diagram showing a connection state of a connection part.

An image forming apparatus 20 of the present invention is built in the center of an electrophotography printing apparatus (printer) 1, and has four printing machineries respectively being four kinds of color ingredients of YMCK from right side of FIG. 1.

To describe in detail, as shown by the FIG. 1, a yellow printing machinery 4, a magenta printing machinery 5, a cyan printing machinery 6, and a black printing machinery 7 are provided in tandem form. Each of printing machineries is attachable and removable with respect to printer and has same structure. In respective printing machineries, only the colors of respective developers (toners) are different. Here, the yellow printing machinery 4 will be explained as a representation.

In the yellow printing machinery 4, a developing apparatus (image drum cartridge) 4*a* having an attachable and removable accommodating unit (toner cartridge) to accommodate developer (toner); a LED head 4*b* installed on a cover which will be stated below; an electricity removing lamp 4*c*; and a transferring roller 4*e* are included.

As shown by FIGS. 1 and 2, the developing apparatus 4*a* unifies a photosensitive body roller (drum) 22; a charging roller 23 located in a circumscribed position with the hotosensitive body roller 22; a developing section 24; a cleaning roller 25; a conveying section 26; a light emitting section 27; a light shading section 28; a conveying section driving gear 29 and a photosensitive body driving gear 30. So the developing apparatus 4*a* is attachable and removable with respect to the printing apparatus 1 as an expendable supplies.

Under the image forming apparatus 20, a transfer belt 11 is furnished rotatably. The transfer belt 11 is to convey a print medium P with holding the print medium P, so it is located around a driving roller 11*a* and a driven roller 11*b* so as to be driven to rotate. Further, under the transfer belt 11, a cassette tray 8 is installed. In the cassette tray 8, the print medium (sheet) P is stacked in the cassette tray 8 and is sent out upward one by one through a hopping roller 9.

On the left side of the image forming apparatus 20, a fixing unit 12 is furnished. The fixing unit 12 has a heating roller 12*a*and a pressing roller 12*b* in order to fixing a toner image transferred on the print medium P onto the print medium P.

On a upper portion of the image forming apparatus 20, a cover 13 is furnished so as to be capable of opening and closing. On the cover 13, the above-mentioned respective LED heads 4*b*, 5*b*, 6*b* and 7*b* are installed. Moreover, the upper portion is a stacker portion 13*a* in which the sent print medium P is placed.

Further, on the image forming apparatus 20, a low voltage power source 2 and a high voltage power source 3 are furnished. The low voltage power source 2 supplies electric power to a heat source in the fixing unit 12, that is, to a halogen lamp in the heating roller 12*a*. The high voltage power source 3 is formed so as to independently supplies electric powers of high voltage to the respective developing apparatus 4*a*, 5*a*, 6*a* and 7*a*; and the respective transferring roller 4*e*, 5*e*, 6*e* and 7*e*, and is controlled so as to provide voltages to correspond to respective toner colors and respective installation positions of developing apparatuses.

As shown by FIG. 2, a controlling section 33 built in the printing apparatus 1 controls whole operations of the image forming apparatus 20, and controls-rotation of a motor 4*d* to drive the yellow developing apparatus 4*a*.

As shown by FIGS. 4 and 5, the controlling section 33 is connected with the substance of the printing apparatus 1 through the developing apparatus 4*a* and a connection part (electroconductive member) 32 with electroconductivity such as spring part (force providing part) with spiral shape. Through moving from a non-connection state of FIG. 4 to a connection state of FIG. 5, the connection part (electroconductive member) 32 is installed into between a projection 1-1 of the substance of the printing apparatus 1 and a projection 32-1 of the developing apparatus 4*a*. Then, an electric power of the substance side of the printing apparatus 1 is supplied to the side of the developing apparatus 4*a*. Moreover, in the state that the developing apparatus 4*a* of FIG. 4 is removed, even if user touches with the connection part (electroconductive member) 32, the static electricity flows to a frame ground (FG).

The photosensitive body roller 22 is driven by the photosensitive body driving gear 30 through the motor 4*d* controlled by the controlling section 33. The photosensitive body driving gear 30 is formed in order to drive the conveying section driving gear 29 for driving the developer (toner) conveying section 26 located over the developing section 24 so that the light shading section 28 operates to rotate in an operation cycle identical with that of the developer (toner) conveying section 26. That is, the conveying section 26 and the light shading section 28 rotates as an unity.

As shown by FIGS. 2 and 3, the light shading section 28 is a light shading means (light shading board) to operates in an operation cycle identical with that of the developer (toner) conveying section 26, and to be placed in a position facing to the light emitting section 27 built in the image forming apparatus 20 for shading the emitted light. To describe it in detail, between a light receiving element 34 on a substrate of the controlling section 33 and the light emitting section 27, a rotation track is stacked and placed in the developing apparatus 4*a*. The rotation track is placed to shade irradiation light from the light emitting section 27 with respect to the light receiving element 34 built in the printing apparatus 1. That is, through forming a shading surface on the light shading section 28, whose acreage is larger than an opening acreage of a window 4A of the developing apparatus 4*a* and through placing the shading surface near to the window 4A, the light shading section 28 acts so that the light does leak to the outside.

FIGS. 6-10 are used to indicate driving state of the developing apparatus 4*a*.

Figure 6A:
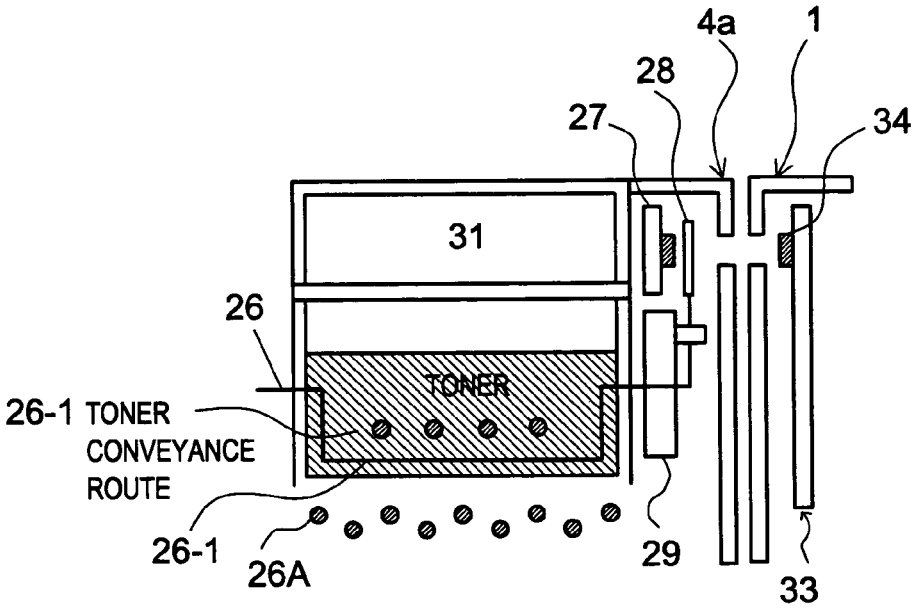
FIG. 6A is a diagram showing a structure of an important portion of circumstance of a developing apparatus in FIG. 2.
Figure 6B:
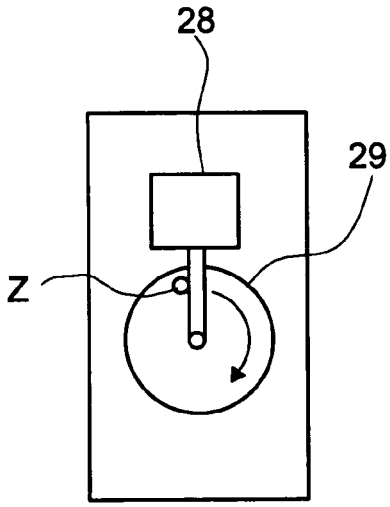
FIG. 6B is a diagram showing a circumstance portion of a light shading section in FIG. 6A.
Figure 7A:
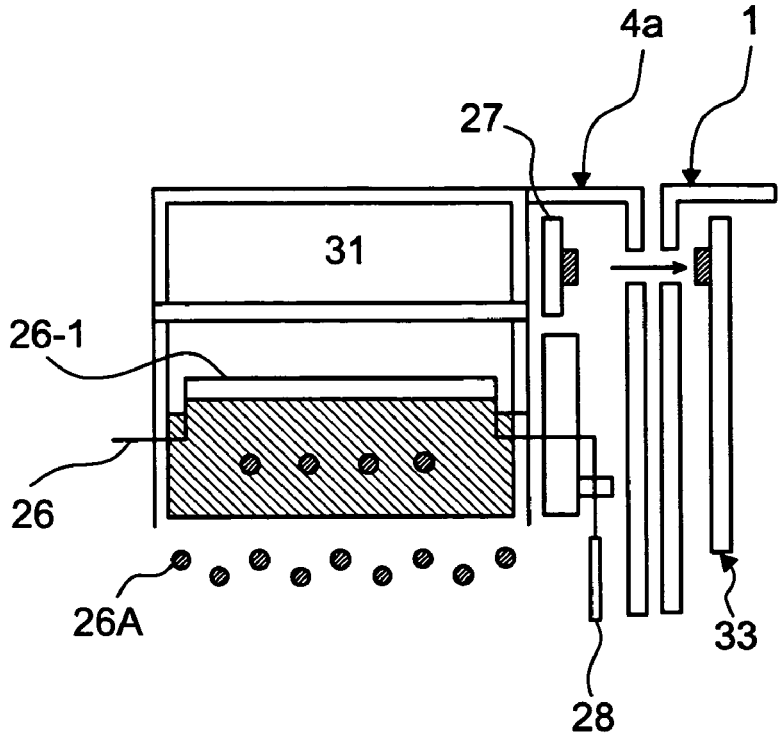
FIG. 7A is a diagram showing a state in which a light shading section rotated about 180 degrees from a state of FIG. 6A.
Figure 7B:
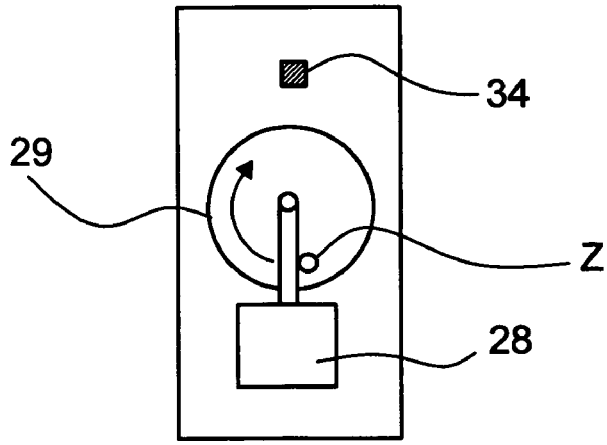
FIG. 7B is a diagram showing a circumstance portion of a light shading section in FIG. 7A.
Figure 8:
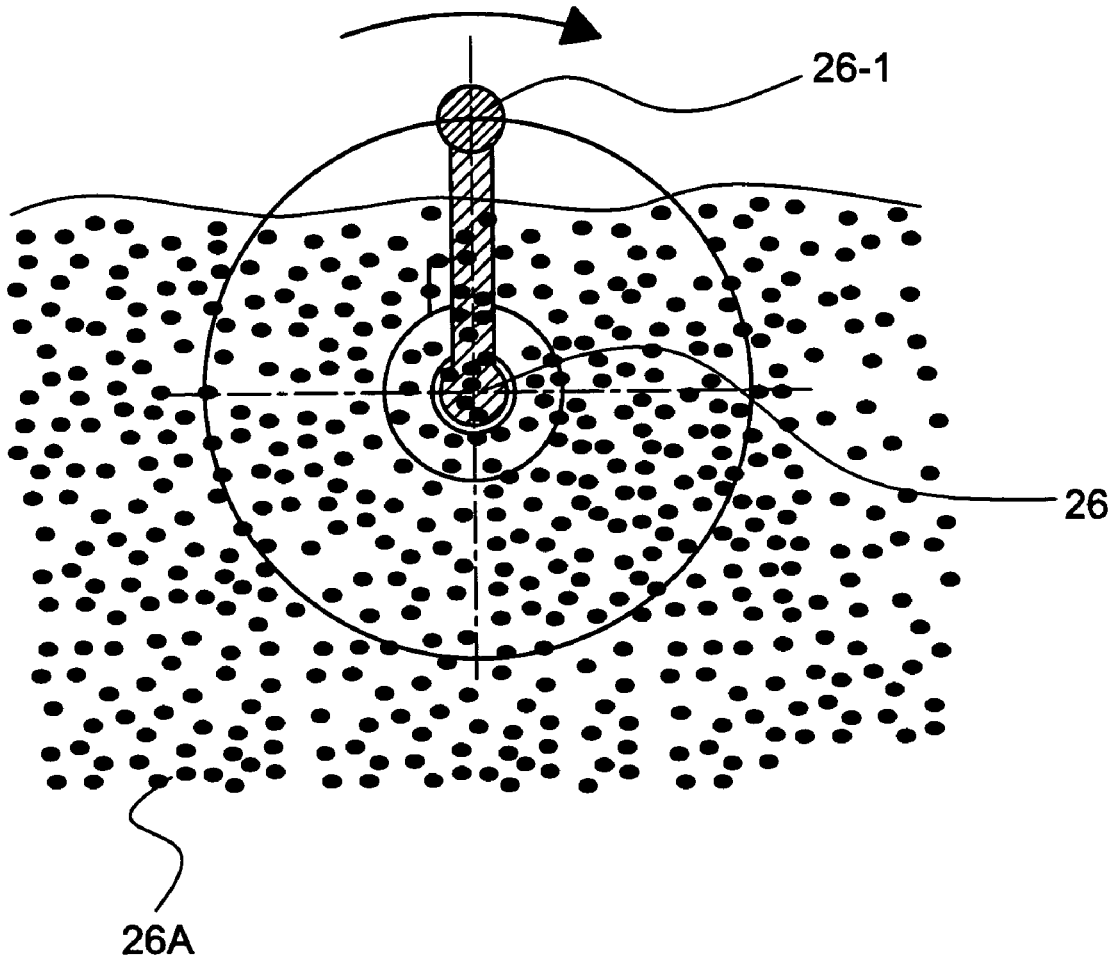
FIG. 8 is a diagram showing a circumstance portion of a tip portion of a developer (toner) conveying section in FIG. 7A.
Figure 9A:
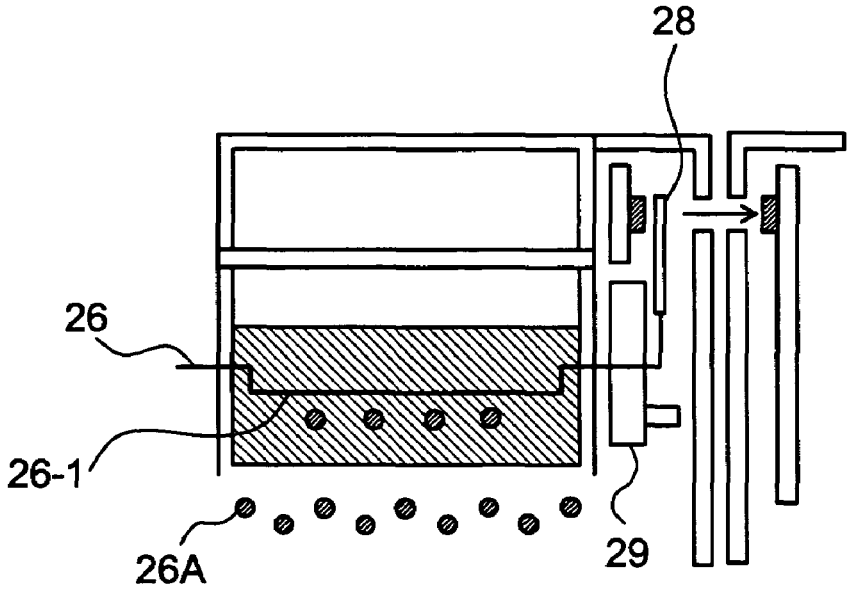
FIG. 9A is a diagram showing a state in which a light shading section further rotated about 135 degrees from a state of FIG. 7A.
Figure 9B:
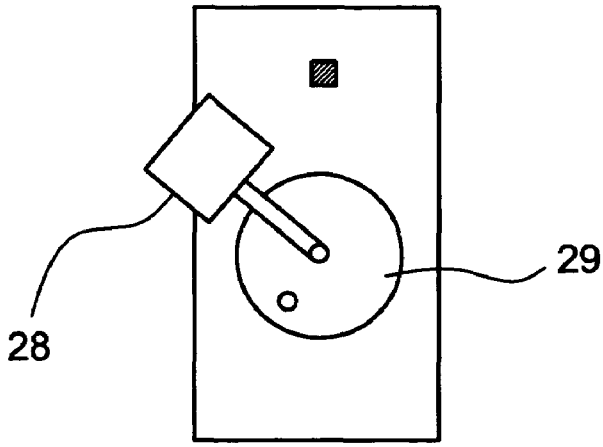
FIG. 9B is a diagram showing a circumstance portion of a light shading section in FIG. 9A.
Figure 10:
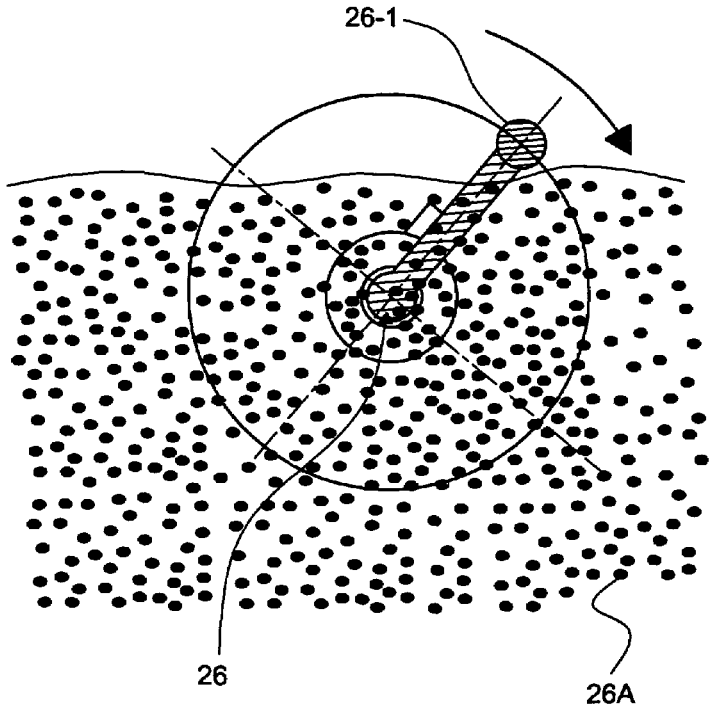
FIG. 10 is a diagram showing a state in which a tip portion of a developer (toner) conveying section rotated from a state of FIG. 7A.

FIG. 6A is a diagram showing a structure of an important portion of circumstance of a developing apparatus in FIG. 2; FIG. 6B is a diagram showing a circumstance portion of a light shading section in FIG. 6A; FIG. 7A is a diagram showing a state in which a light shading section rotated about 180 degrees from a state of FIG. 6A; FIG. 7B is a diagram showing a circumstance portion of a light shading section in FIG. 7A; FIG. 8 is a diagram showing a circumstance portion of a tip portion of a developer (toner) conveying section in FIG. 7A; FIG. 9A is a diagram showing a state in which a light shading section further rotated about 135 degrees from a state of FIG. 7A; FIG. 9B is a diagram showing a circumstance portion of a light shading section in FIG. 9A; and FIG. 10 is a diagram showing a state in which a tip portion of a developer (toner) conveying section rotated from a state of FIG. 7A.

The photosensitive body driving gear 30 driven by the motor 4*d* connected with the controlling section 33 is installed to drive the conveying section driving gear 29 in a clockwise direction; and to drive the conveying section 26 having the same rotation center as the conveying section driving gear 29 has and the light shading section 28 installed on the conveying section 26 to rotate in the same clockwise direction. To describe it in detail, as shown by FIGS. 6A, 6B, 7A and 7B, when a tip portion 26-1 of the conveying section 26 locates in an under dead point position of downside, the light shading section 28 is placed in an upper dead point position of upside.

As shown by FIG. 6A, on the one hand, the conveying section 26 has an action to stir developer (toner) in a developer (toner) conveyance route over the developing section 24. On the other hand, the light shading section 28 locates above the conveying section driving gear 29. At that time, the irradiation light from the light emitting section 27 is shaded. Further, as shown by FIG. 6B, the light shading section 28 is furnished rotate-freely with respect to the conveying section driving gear 29 on which a projecting portion Z is formed. When the conveying section driving gear 29 rotates, the projecting portion Z contacts with the light shading section 28, as a result, the light shading section 28 rotates through a free fall. That is, the conveying section 26 and the light shading section 28 are held rotate-freely with respect to the conveying section driving gear 29, and rotates through pressed by the conveying section driving gear 29 and the projecting portion Z.

As shown by FIG. 7A, through the rotation caused by the drive of the conveying section driving gear 29, the tip portion 26-1 of the conveying section 26 placing in the developer (toner) conveyance route locates the upper dead point position. At that time, as shown by FIG. 7B, the light shading section 28 moves to the under dead point position, then the irradiation light of the light emitting section 27 irradiates the light receiving element 34 (light receiving section 34).

Continuously, regarding operations of the printing apparatus 1 in the embodiment 1 of the present invention, it will be explained in detail together with drawings.

The motor 4*d* of the controlling section 33 makes the photosensitive body roller 22 rotate. Through the photosensitive body roller 22 takes a charge on surface, an electrostatic latent image is formed on the photosensitive body roller 22 to correspond to image information. Then, the developer (toner) with predetermined quantity filled in a developer container 31 is provided to an accommodating portion of the developing section 24 built in the developing apparatus 4*a* by the conveying section 26 to develop a toner image on the photosensitive body roller 22 on which the electrostatic latent image is formed.

To synchronize with the rotation operation of the photosensitive body roller 22, the photosensitive body driving gear 30 drives the conveying section driving gear 29 in a clockwise direction, and makes the conveying section 26 having the same rotation center as the conveying section driving gear 29 and the light shading section 28 installed on the conveying section 26 rotate in the same clockwise direction.

As shown by FIG. 6A, in the conveying section 26, the tip portion 26-1 of the conveying section 26, which has a function to stir the toner in the toner conveyance route, is placed in the under dead point under the rotation center. In the case, as shown by FIG. 6B, the light shading section 28 is placed in the upper dead point of "0 o'clock" via the conveying section driving gear 29.

As shown by FIG. 7A, through driving the conveying section driving gear 29, the tip portion 26-1 of the conveying section 26 rotatively moves to a position of the upper dead point above the rotation center (refer to FIG. 8).

Figure 11:
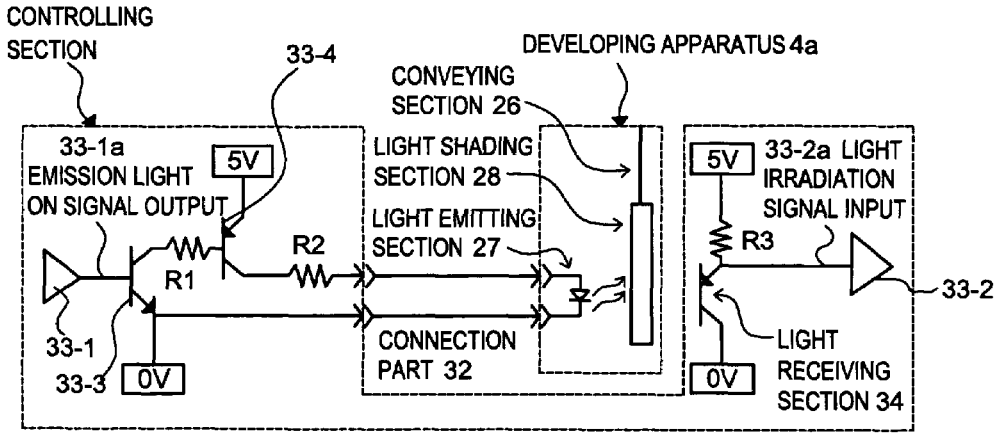
FIG. 11 is an electronic circuit diagram relative to a developer accommodating apparatus, a developing apparatus and an image forming apparatus in embodiment 1 of the present invention.
Figure 12:
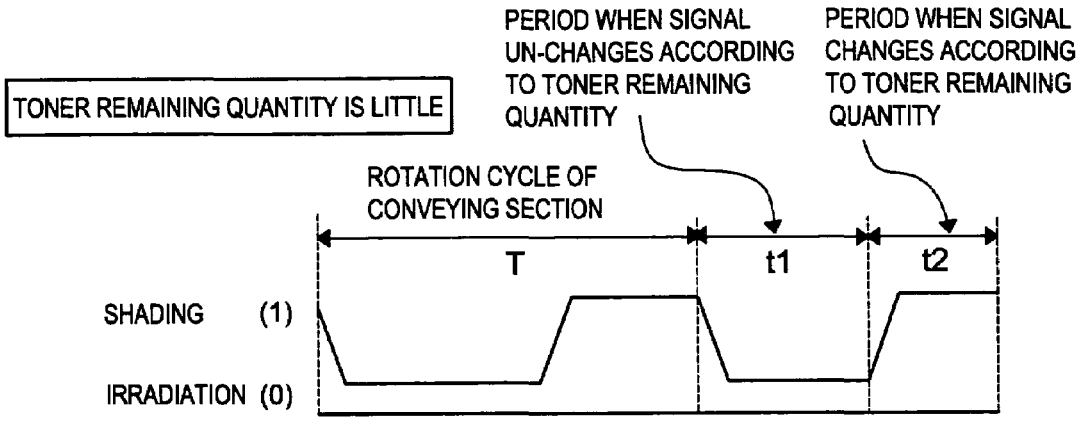
FIG. 12 is a timing chart showing a transition of a light irradiation signal in a light irradiation signal input terminal of FIG. 11 in the case that toner remainder quantity is little.
Figure 13:
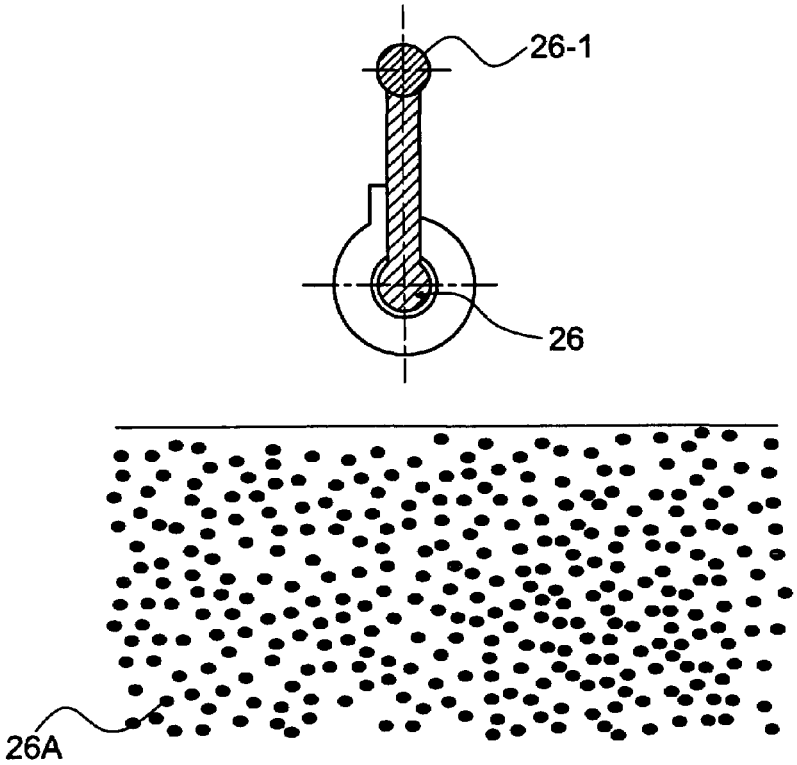
FIG. 13 is a diagram showing a state in which a tip portion of a developer (toner) conveying section is in an upper dead center position of "0 o'clock" in the case that toner remainder quantity is little in FIG. 12.
Figure 14:
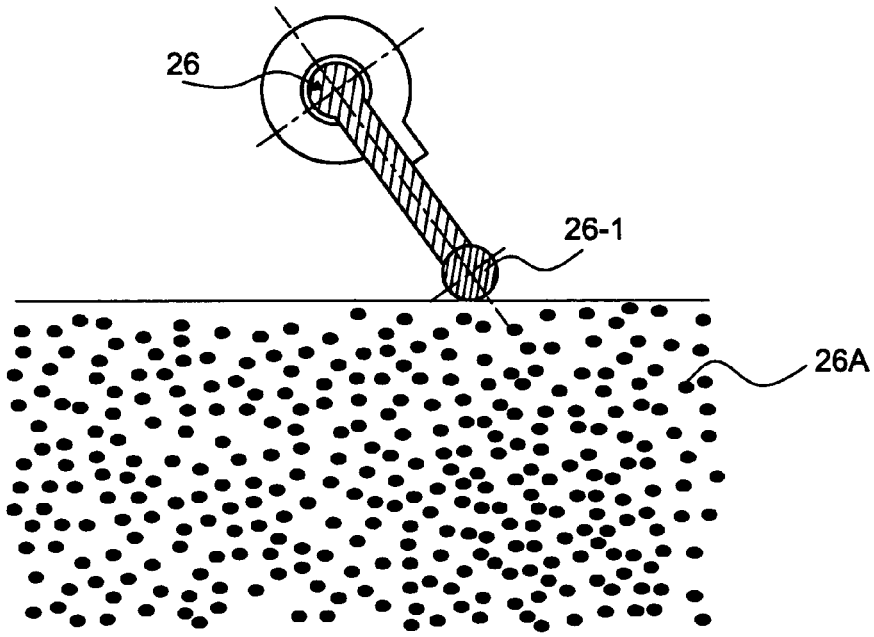
FIG. 14 is a diagram showing a state in which a tip portion of a developer (toner) conveying section of FIG. 13 instantaneously rotated to a position of "5 o'clock" from a position of "0 o'clock"
Figure 15:
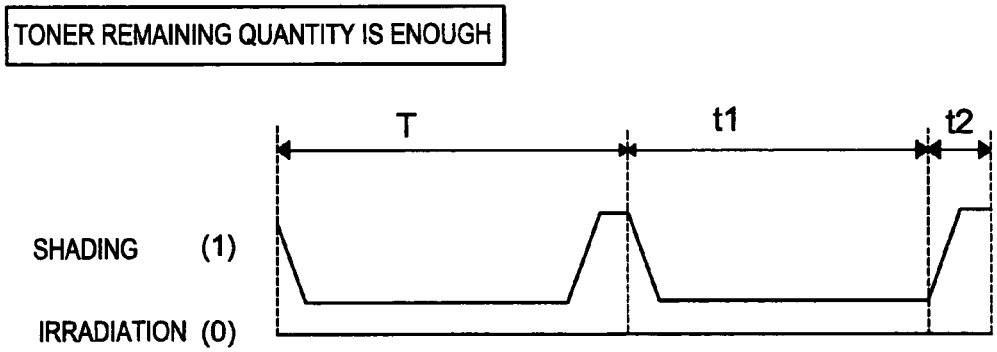
FIG. 15 is a timing chart showing a transition of a light irradiation signal in a light irradiation signal input terminal of FIG. 11 in the case that toner remainder quantity is sufficient much and the state of a tip portion of a developer (toner) conveying section corresponds to FIGS. 8 and 10.

FIG. 11 is an electronic circuit diagram relative to a developer accommodating apparatus, a developing apparatus and an image forming apparatus in embodiment 1 of the present invention; FIG. 12 is a timing chart showing a transition of a light irradiation signal in a light irradiation signal input terminal of FIG. 11 in the case that toner remainder quantity is little; FIG. 13 is a diagram showing a state in which a tip portion of a developer (toner) conveying section is in an upper dead center position of "0 o'clock" in the case that toner remainder quantity is little in FIG. 12; FIG. 14 is a diagram showing a state in which a tip portion of a developer (toner) conveying section of FIG. 13 instantaneously rotated to a position of "5 o'clock" from a position of "0 o'clock"; and FIG. 15 is a timing chart showing a transition of a light irradiation signal in a light irradiation signal input terminal of FIG. 11 in the case that toner remainder quantity is sufficient much and the state of a tip portion of a developer (toner) conveying section corresponds to FIGS. 8 and 10.

As shown by FIG. 11, the controlling section 33 includes a input terminal to receive an emission light ON signal; a buffer 33-1 which generates an emission light ON signal output 33-1*a*; and a buffer 33-2 which receives a light irradiation signal input 33-2*a*. As a result to generate the emission light ON signal output 33-1*a* and to switch on a transistor 33-3 and a transistor 33-4, an electricity which comes from a 5V power source and is limited by a resistor R2 is turned on to the connection part 32, and the light emitting element (LED) of the light emitting section 27 emits light.

Further, the light receiving section 34 is a light receiving element, that is, is a photoelectric change element such as photodiode and the like. When received an irradiation of light, an electricity flows from a 5V power source to 0V (earth) via a resistor R3. On the input terminal of the buffer 33-2, "0" (L level) is inputted as the light irradiation signal input 33-2*a*. However, as shown by FIG. 11, in the case that the light shading section 28 moves upward and locates in between the light emitting section 27 and the light receiving section 34, in the light receiving section 34, on the input terminal of the buffer 33-2, there is no irradiation of light from the light emitting section 27, "1" (H level) is inputted as the light irradiation signal input 33-2*a*.

As shown by FIGS. 13 and 14, when the tip portion 26-1 of the conveying section 26 placing in the toner conveyance route freely falls in self-weight and locates in the bottom of the toner conveyance route, the light shading section 28 moves upward and stops in a light shading position.

FIG. 12 indicates the case that toner remaining quantity in 10 the toner conveyance route becomes little, and FIG. 15 indicates a light irradiation signal input change in the case that the case that toner remaining quantity in the toner conveyance route is enough.

As described above, because the conveying section 26 locates in the toner conveyance route and synchronizes with the rotation cycle of the photosensitive body roller 22, the conveying section 26 rotates in a fixed rotation cycle regardless of toner remaining quantity. In a period when the conveying section 26 rotates by the conveying section driving gear 29 in FIG. 6A, the light irradiation signal input 33-2*a* does not change. When the conveying 20 section 26 leaves the control of the conveying section driving gear 29 in FIG. 7A and locates in the upper dead point above rotation center, because it freely falls in self weight, in the case that the toner is filled in, as shown by FIG. 9, it stops to fall due to the load of the toner, so the shading time becomes short.

In consequence, because the more enough the toner remaining quantity is, the shorter the shading time is, in the fixed rotation cycle of the conveying section 26, a duty ratio of irradiating time (light irradiation signal "0") and shading time (light irradiation signal "1") produces change.

The duty ratio is detected by the controlling section 33, through referring to the toner remaining quantity corresponding to previously decided value, the controlling section 33 detects the toner remaining quantity.

As shown by FIG. 6A, when the tip portion 26-1 of the conveying section 26 having an action to stir toner in the toner conveyance route freely falls in self-weight and locates in the bottom of the toner conveyance route, the tip portion 26-1 of the conveying section 26 of FIG. 6B locates in upside above the rotation center.

In the case that the toner remaining quantity is little, because the conveying section 26 freely-falls immediately from the state of FIG. 13 to the state of FIG. 14, the period when the conveying section 26 rotates through a drive of the conveying section driving gear 29 is short. As shown by FIG. 12, the period (irradiating time) t1 when the light irradiation signal input 33-2*a* does not change according to the toner remaining quantity becomes short, and the shading time t2 becomes long.

As compared with the above case, in the case that the toner remaining quantity is enough, the irradiating time t1 becomes long, as shown by FIG. 15, the duty ratio (t2/t1) of the shading time t2 and the irradiating time t1 of light emitting element of the light emitting section 27 reduces.

That is, in the case that the toner is enough filled (FIG. 8), the conveying section 26 (& the light shading section 28), while being pressed by the projecting portion Z, rotates at all times in the same cycle as that of gear. Therefore, the cycle becomes such cycle as shown in FIG. 15.

In the case that the toner is little (as shown by FIG. 14), the conveying section 26 is moved to a highest position. When it is further pressed, because it is supported as rotating freely, so the conveying section 26 freely falls in self-weight, and moves to a low position. At that time, it operates in a cycle different from that of the gear. Then, when the conveying section 26 locates the low position, the light shading section 28 locates in a high position to shade light.

Later, through the projecting portion Z presses the conveying section 26 locating the low position in the cycle of the gear, the light shading section 28 is moved again, and the shading of light is cancelled. Because the conveying section 26 falls before the cycle of the gear ends and the light shading section 28 shades light, the shading time becomes long. In the case that the toner is little, the cycle becomes such cycle as shown in FIG. 12.

Further, the light shading section 28 is sufficient lighter than the conveying section 26.

Furthermore, in the case that the toner is much, even if the conveying section 26 is pressed from the highest position, because there is a resistance of the toner, it can not freely fall.

The present invention has a such feature: the developing apparatus comprises the light shading section which synchronizes with the light emitting element and the conveying section. In the embodiment 1 of the present invention, it is unnecessary to use a reflection part making light quantity attenuate and to secure a large space in which reflectance is low for shading reflection light. Because it is possible to minimize the structure of light path, so the emission light quantity of the light emitting element can be low inhibited. As a result, it is possible to inhibit an influence of irregular reflection light, and to improve a detection stability of the toner remaining quantity.

Embodiment 2

Figure 16:
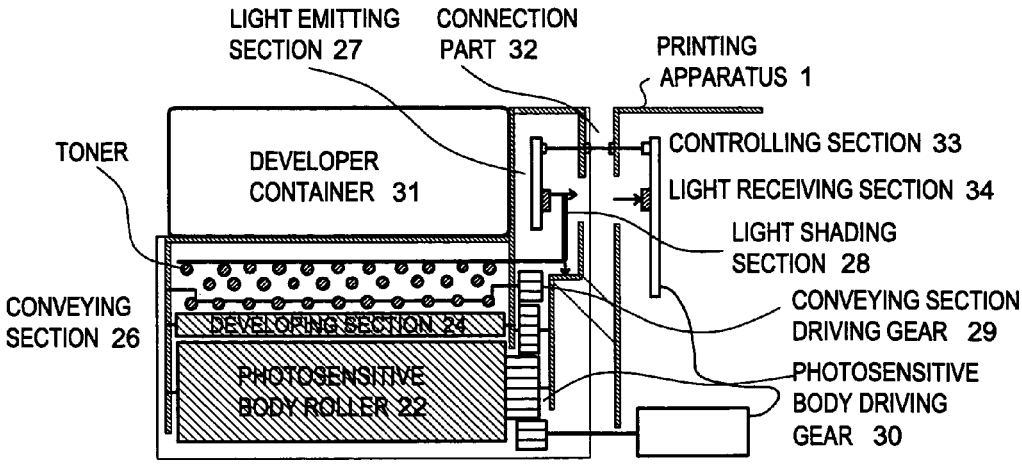
FIG. 16 is a diagram showing an important portion relative to a developer accommodating apparatus, a developing apparatus and an image forming apparatus in embodiment 2 of the present invention.
Figure 17:
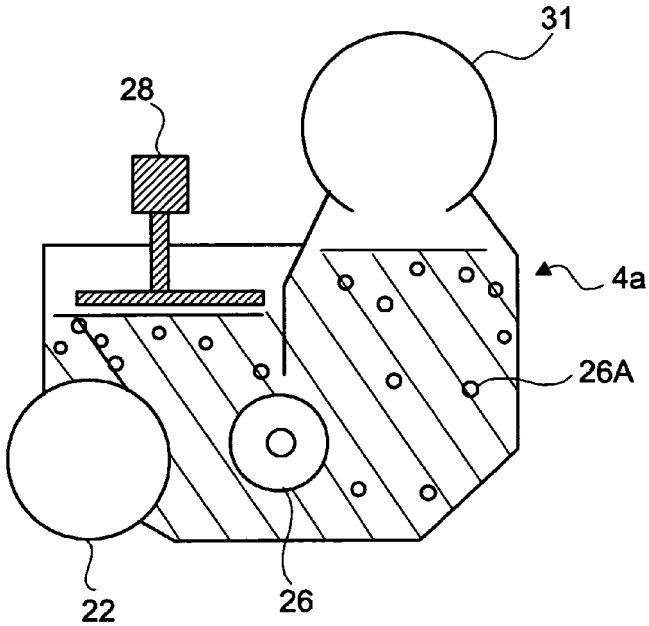
FIG. 17 is a diagram showing a developing apparatus in FIG. 16.

FIG. 16 is a diagram showing an important portion relative to a developer accommodating apparatus, a developing apparatus and an image forming apparatus in embodiment 2 of the present invention; and FIG. 17 is a diagram showing a developing apparatus in FIG. 16.

In the embodiment 2, there is a different point than the embodiment 1, it is: a light shading section 28 is provided which drops in a toner conveyance route according to a toner remaining quantity of toner filled in the developing apparatus 4*a*, and shades light from a light emitting section 27 according to a developer surface.

Differently from the embodiment 1, the light shading section 28 is not linked moving together with the conveying section 26. Therefore, it is placed at a position having no influence with respect to operation of the photosensitive body driving gear 30 or conveying section driving gear 29 driven by the controlling section 33.

one part of the light shading section 28 built in the toner conveyance route is furnished levelly with the developer surface, and drops toward a direction adjacent to the conveying section 26 to the same position as the developer surface which drops according to toner consumption produced by print. The conveying section 26 has a function to stir and convey the toner so as to level the developer surface.

Further, another part of the light shading section 28 furnished at the outside of the toner conveyance route is placed between the light emitting section 27 and the light receiving section 34. While the developer surface drops due to toner consumption, the light shading section 28 also drops synchronistically, and moves to a direction to secure light path formed by the light emitting section 27 and the light receiving section 34.

When the toner becomes little, the light path is completely secured. In order that the irradiation quantity of light emitted from the light emitting section 27 to the light receiving section 34 becomes biggest, the light shading section 28 is furnished so as that its driving range is limited.

Next is to explain operations of the developer accommodating apparatus, developing apparatus and image forming apparatus in the embodiment 2 of the present invention.

The light shading section 28, differently from the embodiment 1, is not linked moving together with the conveying section 26. Therefore, without having influence with respect to operation of the photosensitive body driving gear 30 or conveying section driving gear 29 driven by the controlling section 33, the one part of the light shading section 28 built in the toner conveyance route drops toward a direction adjacent to the conveying section 26 to the same position as the developer surface which drops according to toner consumption produced by print.

Further, the another part of the light shading section 28 furnished at the outside of the toner conveyance route is placed between the light emitting section 27 and the light receiving section 34. While the developer surface drops due to toner consumption, the light shading section 28 also drops synchronistically, and moves to a direction to secure light path formed by the light emitting section 27 and the light receiving section 34.

When the toner becomes little, the light shading section 28 moves to the downside under the light path formed by the light emitting section 27 and the light shading section 28. Therefore, the light path is completely secured, and the irradiation of light emitted from the light emitting section 27 to the light receiving section 34 becomes much slowly.

In consequence, the more enough the toner remaining quantity is, the more the light is shaded; and the less the toner remaining quantity is, the more the light receiving quantity of the light receiving section 34 increases. Therefore, the controlling section 33 detects the light receiving quantity, and refers to a toner quantity corresponding to a light receiving quantity previously decided. Thus, the controlling section 33 can control the toner remaining quantity in the developer container and the developing apparatus 4*a*.

In the embodiment 1, till the toner remaining quantity is detected, in rotation operation of the conveying section 26, the time of at least one cycle is needed. However, in the embodiment 2, according to the toner remaining quantity, a light shading quantity is decided. Therefore, if only detecting the light receiving quantity of the light receiving section 34, the toner quantity becomes stable. As a result, it is possible to get a detection of high speed.

Because the longer the emission light time is, the worse the light emitting section 27 is, the emission light time can be shortened than that in the embodiment 1. Therefore, it is possible to inhibit the bad of the light emitting section 27 and improve continuous supply ability of the stable light quantity. As a result, with respect to the toner remaining quantity detection result, the detection stability improves.

Further, in the explanation above stated, such example is indicated as that: in the case that the toner remaining quantity is filled enough, the light shading section 28 completely shades the irradiation of light emitted from the light emitting section 27 to the light receiving section 34.

However, in the case that the toner remaining quantity is filled enough, even if limiting the operation range of the light shading section 28 in order that the irradiation quantity of light toward the light receiving section 34 becomes biggest, the controlling section 33 can control the toner remaining quantity in the developer container and the developing apparatus 4*a*.

As explained above, the present invention has such feature: there is a light shading section which, with respect to the developer surface dropping according to the remaining quantity of the developer filled in the developing apparatus, shades the light emitted from the light emitting section according to the developer surface.

Through executing the embodiment 2, like the embodiment 1, it is unnecessary to use a reflection part making light quantity attenuate and to secure a large space in which reflectance is low for shading reflection light. Therefore, it is possible to minimize the structure of light path, and the emission light quantity of the light emitting element can be low inhibited. As a result, it is possible to inhibit an influence of irregular reflection light, and to improve a detection stability of the toner remaining quantity.

Further, because the light shading section is not linked moving together with the conveying section, with respect to the embodiment 1 in which till the toner remaining quantity is detected, the time of at least one cycle is needed in rotation operation of the conveying section 26, in the embodiment 2, a light shading quantity is decided according to the toner remaining quantity. Therefore, if only detecting the light receiving quantity of the light receiving section 34, the toner quantity becomes stable. As a result, it is possible to get a detection of high speed.

Embodiment 3

Figure 18:
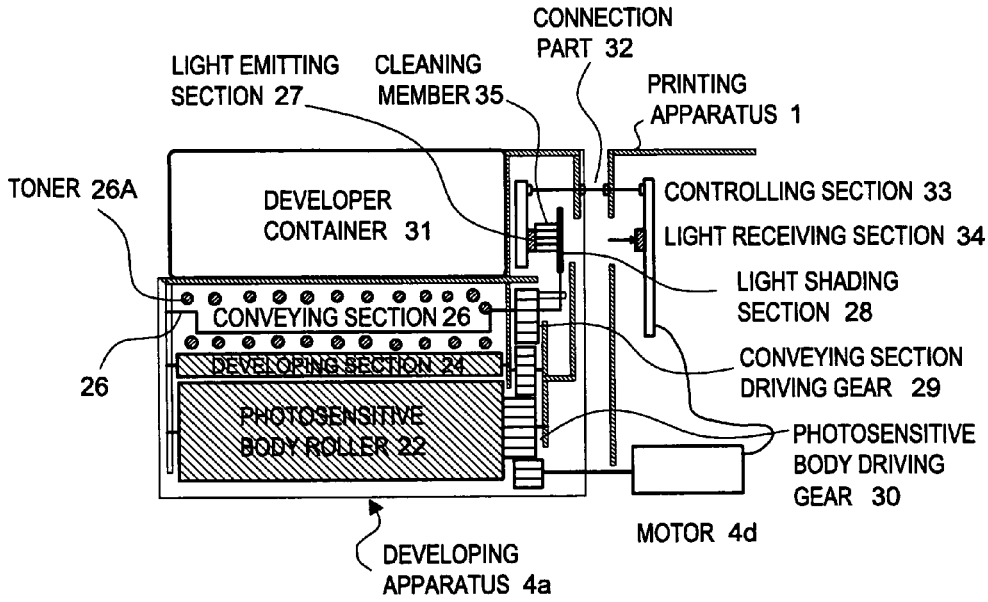
FIG. 18 is a diagram showing a structure of an important portion relative to a developer accommodating apparatus, a developing apparatus and an image forming apparatus in embodiment 3 of the present invention.

FIG. 18 is a diagram showing a structure of an important portion relative to a developer accommodating apparatus, a developing apparatus and an image forming apparatus in embodiment 3 of the present invention.

In the embodiment, there is a different point than the embodiment 1, it is: a cleaning member 35 is provided on a plane of the light shading section 28 to face to the light emitting section 27.

In the case that the cleaning member 35 is toward a position which faces to the light emitting section 27 in rotation operation of the light shading section 28, the cleaning member 35 acts to scrape minute dust or toner adhering to the surface of the light emitting section 27.

Thereby, the cleaning member 35 is formed from brush material having elasticity becoming a load in a permissible range of detection error with respect to the rotation operation of the light shading section 28.

The cleaning member 35, in the case that it is toward a position which faces to the light emitting section 27 in rotation operation of the light shading section 28, acts to scrape minute dust or toner adhering to the surface of the light emitting section 27.

Therefore, through repeated brushing operations, the impurity such as minute dust or toner adhering to the surface of the light emitting section 27 is cleaned temporarily.

However, in the case that the cleaning member 35 is formed from brush material having elasticity becoming a load in a permissible range of detection error with respect to the rotation operation of the light shading section 28, the cleaning member 35 obstructs the rotation operation of the light shading section 28. Therefore, it is necessary to inhibit the load in the permissible range of detection error.

Further, in the case that the toner is enough, the light shading section 28, when passing a light emitting section position, through gear, is rotated. Therefore, there is no problem.

The developing apparatus in the embodiment 3 of the present invention has a feature to includes a cleaning member 35 at a plane of the light shading section 28, facing to the light emitting section 27.

Through executing the embodiment 3, like the embodiment 1, it is unnecessary to use a reflection part making light quantity attenuate and to secure a large space in which reflectance is low for shading reflection light. Therefore, it is possible to minimize the structure of light path, and the emission light quantity of the light emitting element can be low inhibited.

As a result, it is possible to inhibit an influence of irregular reflection light, and to improve a detection stability of the toner remaining quantity. Further, it is possible to inhibit the reduction of the emission light quantity of the light emitting section 27, produced by the impurity, and to improve continuous supply ability of the stable light quantity. As a result, the continuous supply ability of the stable light quantity can be improved. Therefore, with respect to the toner remaining quantity detection result, the detection stability improves.

<Variation Example of Electronic Circuit of FIG. 11>

Figure 19:
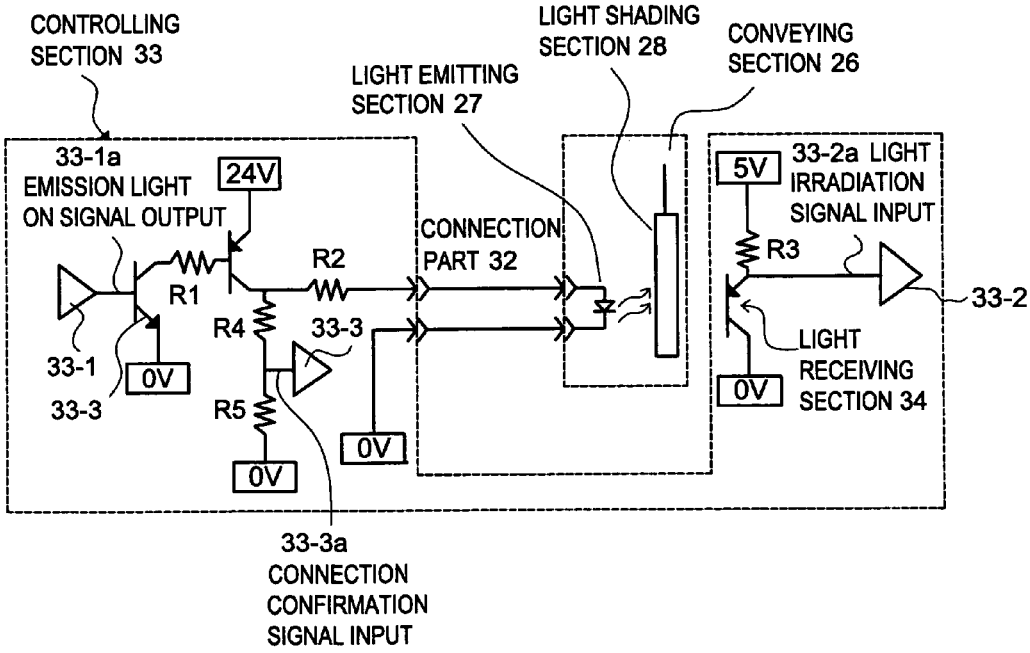
FIG. 19 is a diagram showing a variation example of an electronic circuit in FIG. 11.

FIG. 19 is a diagram showing a variation example of an electronic circuit in FIG. 11.

In the variation example of FIG. 19, in the inside of the controlling section 33, in the case that an emission light ON signal output is generated and it is set to ON, an analog signal voltage produced by a connection confirmation signal input can be detected. In order to detect whether the developing apparatus 4*a* is suitably connected to the controlling section 33, voltage dividing resistors R4 and R5 are installed.

In the state to generate the emission light ON signal output is generated and set it to ON, an emission electricity of the resistor R2, the connection part 32 and the light emitting section 27 flows. But, in the state that the connection part 32 is cut off without suitably connecting, because electricity does not flow to the connection part 32, the voltage value voltage-divided by the resistors R4 and R5 is provided as the connection confirmation signal input.

The controlling section 33 judges that the detected voltage value at that time indicates "non-connection", and sets an analog voltage range.

Further, even if in the state to generate the emission light ON signal output and set it to ON, in the state that connection part 32 is short-circuited with metal member such as frame and the like without suitably connecting, the electricity does not flow to the connection part 32, but the electricity flows to ground (GND) such as frame and the like from the connection part 32 via the resistor R2. Therefore, the voltage value decided by a composite resistor of the R4, the R5 and the R2 is provided as the connection confirmation signal input.

The controlling section 33 judges that the detected voltage value at that time indicates "short-circuit", and sets an analog voltage range.

In the state that there is a normal connection and the emission light ON signal output is generated and it is set to ON, an order direction voltage of the R4, the R5 and the light emitting section 27 is provided as the connection confirmation signal input. The controlling section 33 judges that the detected voltage value at that time indicates "normal", and sets an analog voltage range.

Next is to explain the electronic circuit of the variation example of FIG. 19.

As a preliminary operation before detecting the toner remaining quantity, a connection confirmation signal to detect whether the developing apparatus 4*a* and the controlling section 33 are connected normally is generated.

In the embodiment 1, it is supposed that the cycle of light received by the light receiving section 34 in toner remaining quantity detection operation is different from the rotation cycle of the conveying section 26, and irradiation state or shading state continues.

In the case, the controlling section 33 judges that the developing apparatus 4*a* is bad. However, for the bad judgment, because it is necessary to rotate the conveying section 26 by more than one rotation, so more time is needed for abnormal detection. Further, it is necessary to make the motor 4*d* start to rotate, it makes operator misunderstand that it normally started.

Figure 20:
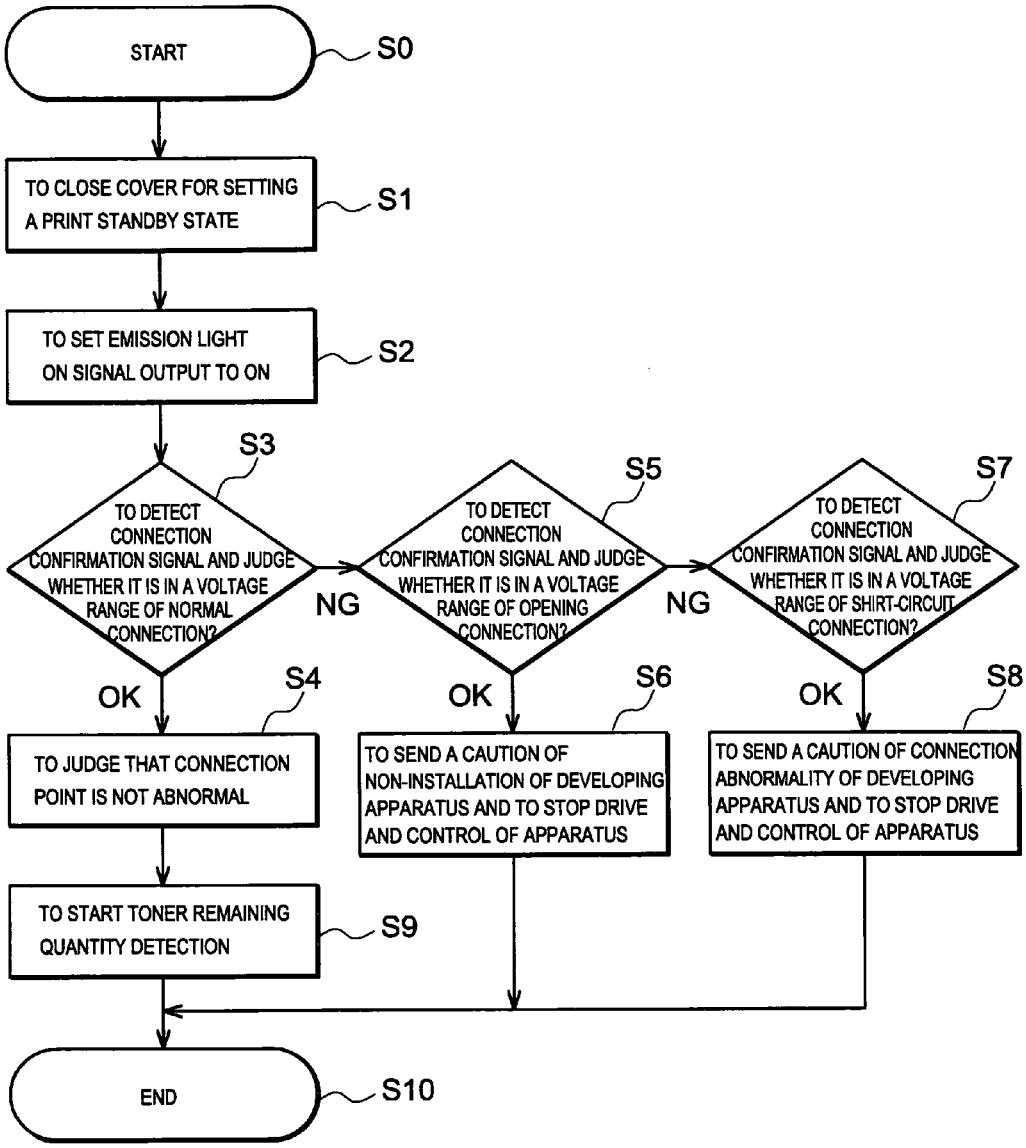
FIG. 20 is a flowchart showing operation of an electronic circuit in FIG. 19.

FIG. 20 is a flowchart showing operation of an electronic circuit in FIG. 19.

When a cover 13 is closed by operator and it becomes a print standby state, the emission light ON signal output 33-1*a* is generated. As a result, a potential of the connection confirmation signal input 33-3*a* is confirmed.

As that time, if a potential of normal connection case is detected, connection point is not abnormal, it is possible to detect that the developing apparatus 4*a* is suitably connected to the printing apparatus 1, and it is possible to start a certain toner remaining quantity detection.

However, if the potential of normal connection case is not detected, but a potential of that the connection part 32 is in an opening state is detected, connection point abnormality or installation abnormality of the developing apparatus is detected, it is possible to remind operator to pay attention before rotate the conveying section 26.

Further, if the potential of normal connection case is not detected, but a potential of that the connection part 32 is in a short-circuit state is detected, connection point abnormality or developing apparatus 4*a* abnormality is detected, through reminding operator to repair before rotate the conveying section 26, drive is stopped.

Moreover, in the electronic circuit of the variation example of FIG. 19, it is such structure to provide the connection confirmation signal input 33-3*a* to an analog voltage input terminal of the buffer 33-1. But it may be such structure to have a means to change comparison voltage with respect to a standard voltage by using a comparator with two input type. It is possible to obtain the same effect to detect the analog voltage range while connection confirmation.

In the electronic circuit of the variation example of FIG. 19, there is a feature to confirm the connection confirmation signal input 33-3*a* in order to detect whether the developing apparatus 4*a* and the controlling section 33 are suitably connected.

In the case to apply the electronic circuit of the variation example of FIG. 19, like the electronic circuit of FIG. 11 in the embodiment 1, it is unnecessary to use a reflection part making light quantity attenuate and to secure a large space in which reflectance is low for shading reflection light. Therefore, it is possible to minimize the structure of light path, and the emission light quantity of the light emitting element can be low inhibited. As a result, it is possible to inhibit an influence of irregular reflection light, and to improve a detection stability of the toner remaining quantity.

In the case to apply the electronic circuit of FIG. 11 in the embodiment 1, till the controlling section 33 detected the emission light abnormality of the light emitting section 27, time of at least one cycle in rotation operation of the conveying section 26 is needed.

With respect to it, in the case to apply the electronic circuit of the variation example of FIG. 19, before detect (S9) the toner remaining quantity, it is possible to detect (S3, S5, S7) connection abnormality such as emission light abnormality and the like or connection part damage. Therefore, it is possible to detect the emission light abnormality and the like at high speed, and to improve detection stability.

Embodiment 4

Figure 21:
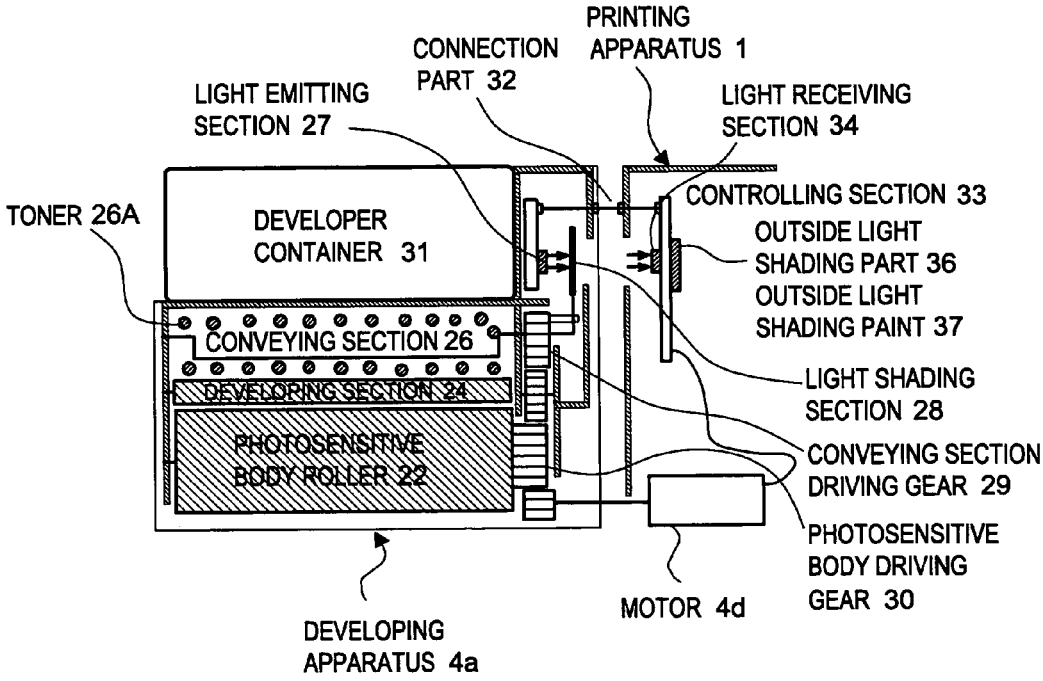
FIG. 21 is a diagram showing a structure of an important portion relative to a developer accommodating apparatus, a developing apparatus and an image forming apparatus in embodiment 4 of the present invention.

FIG. 21 is a diagram showing a structure of an important portion relative to a developer accommodating apparatus, a developing apparatus and an image forming apparatus in embodiment 4 of the present invention.

In the embodiment 4, there is a different point than the embodiment 1, it is: there is an outside light shading part 36 or an outside light shading paint 37.

The controlling section 33 has a substrate formed from a part installation plane for installing the light receiving section 34 and from a back plane having the outside light shading part 36 or the outside light shading paint 37. The outside light shading part 36 is a part to be placed for inhibit outside light that only penetrates the thickness of the substrate, the outside light shading paint 37 is a material with shading ability painted on the same position as the part.

Continuously, regarding the operations of the developer accommodating apparatus, the developing apparatus and the image forming apparatus in embodiment 4 of the present invention, them will be explained in detail.

There is a such case as that the light emitted by the light emitting section 27 enters the light receiving section 34 and is received by the light receiving section 34 without being shaded by the light shading section 28. For example, the light is reflected irregularly by the wall surface of the printing apparatus 1 substance or the wall surface of the developing apparatus 4*a*. Further, there is an outside light from the outside.

Through make an optical axis of the light path formed by the light emitting section 27 and the light receiving section 34 become coincident, it is possible to minimize the irradiation of the light reflected irregularly by the wall surface of the printing apparatus 1 substance or the wall surface of the developing apparatus 4*a*. However, it is necessary to use other means to shade the outside light from the outside.

The outside light enters when to open the cover 13. Only in the case to detect opening and shut of the cover 13 and to shut the cover 13, the controlling section 33 detects the irradiation quantity toward the light receiving section 34.

However, even if the cover 13 is in a shut state, there also is a case that the outside light enters. Further, because the material of the substrate of the controlling section 33 has a light penetration property small amount by small amount in such area having no copper foil pattern, the outside light entering from right side of the controlling section 33 in FIG. 21 becomes a detection error with respect to the light receiving section 34, so it is impossible to detect a stable receiving-light.

Thereby, the substrate of the controlling section 33 is formed from a part installation plane for installing the light receiving section 34 and from a back plane having the outside light shading part 36 or the outside light shading paint 37, and it is best to make the back plane enable the light to be completely shaded as a whole plane pattern.

Because the copper foil pattern on the substrate is used for electric connection, so it is necessary to partly provide copper foil slit as an insulation part. Therefore, it is difficult to set the whole plane pattern.

However, the outside light shading part 36 is a part to be placed for inhibit outside light that only penetrates the thickness of the substrate, the outside light shading paint 37 is a material with shading ability painted on the same position as the part. Therefore, it is possible to paint the outside light shading paint 37 to form a silk pattern. As a result, the irradiation of light emitted from the light emitting section 27 to the light receiving section 34 is stable on the light receiving section 34 and the toner remaining quantity can be detected.

Through applying the structure of the embodiment 4, like the embodiment 1, it is unnecessary to use a reflection part making light quantity attenuate and to secure a large space in which reflectance is low for shading reflection light. Therefore, it is possible to minimize the structure of light path, and the emission light quantity of the light emitting element can be low inhibited.

As a result, it is possible to inhibit an influence of irregular reflection light, and to improve a detection stability of the toner remaining quantity. Further, it is possible to inhibit the outside light from other light emitting source except the light emitting section 27, and to improve a supply ability of stable irradiation-light for the light receiving section 34. therefore, with respect to the toner remaining quantity detection result, the detection stability improves.

USE POSSIBILITY IN INDUSTRY

Regarding the developer accommodating apparatus, the developing apparatus and the image forming apparatus in the above embodiments 1-4 of the present invention, it is explained to apply them to printer as an example, without limit of the printer, they also can be applied to other apparatus using rotation roller such as MFP (Multiple Function Printer), facsimile apparatus, copying apparatus and the like.

To describe in detail, the present invention may use a developer accommodating apparatus, a developing apparatus and an image forming apparatus for detecting toner remaining quantity. If it is possible to detect the toner remaining quantity, the detection result can be used to, for example, setting of stop condition of print, remaining quantity display, remaining quantity notification and the like.

Moreover, in the embodiments of the present invention, a single developing apparatus is explained, but the present invention also may be applied to a color printer having plural developing apparatuses. In the case, according to the number of the plural developing apparatuses, through suitably adding connection parts and detection circuits, the printer having plural developing apparatuses can use the present invention.

Moreover, in the embodiments 1-4 of the present invention, an example in which the toner container is attachable and removable with respect to the developing apparatus is explained. But the developing apparatus may be made to be attachable and removable with respect to the printer substance. Of course, it is possible to make the toner container be not attachable and removable. Further, to replace to furnish the light emitting section and the light shading section on the developing apparatus, it is possible to furnish the light emitting section and the light shading section on the a toner cartridge. Thereby, the present invention can be used as a developer accommodating apparatus.

Through executing the embodiment 3 of FIG. 18, like the embodiment 1, it is unnecessary to use a reflection part making light quantity attenuate and to secure a large space in which reflectance is low for shading reflection light. Therefore, it is possible to minimize the structure of light path, and the emission light quantity of the light emitting element can be low inhibited.

As a result, it is possible to inhibit an influence of irregular reflection light, and to improve a detection stability of the toner remaining quantity. Further, it is possible to inhibit the reduction of the emission light quantity of the light emitting section 27, produced by the impurity, and to improve continuous supply ability of the stable light quantity. As a result, the continuous supply ability of the stable light quantity can be improved. Therefore, with respect to the toner remaining quantity detection result, the detection stability improves.

The present invention is not limited to the foregoing embodiments but many modifications and variations are possible within the spirit and scope of the appended claims of the invention.

What is claimed is:

1. A developing apparatus that is removably attachable to an image-forming apparatus, the developing apparatus comprising:

an accommodating section to accommodate developer;

a light emitting section to emit light toward the outside of said developing apparatus and toward a light-receiving section furnished in the image-forming apparatus when the developing apparatus is attached to the image-forming apparatus, the light-receiving section being disposed outside the developing apparatus; and a light shading section to shade the light emitted from the light emitting section according to a quantity of the developer in said accommodating section.

2. The developing apparatus according to claim 1, wherein said light shading section includes a developer conveying member which is furnished in said accommodating section to rotate and conveys the developer; and a light shading member which rotates together with said developer conveying member and shades the light emitted from the light emitting section.

3. The developing apparatus according to claim 1, wherein said light shading section includes a light shading member which is movable according to a position of corresponding to a surface of the developer inside said accommodating section and shades the light emitted from the light emitting section.

4. The developing apparatus according to claim 2, wherein said developer conveying member has a shading duty ratio changing member which changes a shading duty ratio in rotation cycle of said light shading member according to the quantity of the developer.

5. The developing apparatus according to claim 4, further comprising:

a cleaning member to clean said light emitting section.

6. An image forming apparatus, comprising:

a developing apparatus removably attached to the image forming apparatus and having an accommodating section to accommodate developer;

a light receiving section that is furnished in the image forming apparatus, the light receiving section being disposed outside the developing apparatus; and a developer quantity detecting section, wherein said developing apparatus includes a light emitting section to emit light toward the outside of said developing apparatus; and a light shading section to shade the light emitted from the light emitting section according to a quantity of the developer in said accommodating section;

wherein said light receiving section receives the light emitted from said light emitting section; and wherein said developer quantity detecting section detects the quantity of the developer in said accommodating section on the basis of the light received by said light receiving section.

7. The image forming apparatus according to claim 6, wherein said light shading section includes a developer conveying member which is furnished in said accommodating section to rotate and conveys the developer; and a light shading member which rotates together with said developer conveying member and shades the light emitted from the light emitting section.

8. The image forming apparatus according to claim 6, wherein said light shading section includes a light shading member which is movable according to a position of corresponding to a surface of the developer inside said accommodating section and shades the light emitted from the light emitting section.

9. The image forming apparatus according to claim 7, wherein said developer conveying member has a shading duty ratio changing member which changes a shading duty ratio in rotation cycle of said light shading member according to the quantity of the developer.

10. The image forming apparatus according to claim 9, wherein said developing apparatus further includes a cleaning member to clean said light emitting section.

11. The image forming apparatus according to claim 6, further comprising:

a connection state detecting section to detect whether said developing apparatus is normally connected.

12. The image forming apparatus according to claim 6, further comprising:

an outside light shading member to shade an outside light toward said light receiving section.

13. A developer accommodating apparatus that is removably attachable to a developing apparatus and has an accommodating section to accommodate developer, comprising:

a light emitting section to emit light toward the outside of said developer accommodating apparatus, and toward a light-receiving section that is disposed outside the developing apparatus; and a light shading section to shade the light emitted from the light emitting section according to a quantity of the developer in said accommodating section.

14. The developing apparatus according to claim 2, comprising a projection, wherein the light shading member and developer conveying member are rotated by the projection, the conveying section includes a tip portion to stir the developer and the tip portion is rotated by the projection through an upward 180 degrees of rotation and then falls freely by its weight until it is supported by a surface of the developer, whereby the light shading member has a shading duty ratio in a rotation cycle of said light shading member that varies with an amount of the developer.

15. The image forming apparatus of claim 7, comprising a projection, wherein the light shading member and developer conveying member are rotated by the projection, the conveying section includes a tip portion to stir the developer and the tip portion is rotated by the projection through an upward 180 degrees of rotation and then falls freely by its weight until it is supported by a surface of the developer, whereby the light shading member has a shading duty ratio in a rotation cycle of said light shading member that varies with an amount of the developer.

16. The developer accommodating apparatus of claim 13, comprising a projection, wherein said light shading section includes a developer conveying member which is furnished in said accommodating section to rotate and conveys the developer and a light shading member which rotates together with said developer conveying member and shades the light emitted from the light emitting section, and wherein the light shading member and developer conveying member are rotated by the projection, the conveying section includes a tip portion to stir the developer and the tip portion is rotated by the projection through an upward 180 degrees of rotation and then falls freely by its weight until it is supported by a surface of the developer, whereby the light shading member has a shading duty ratio in a rotation cycle of said light shading member that varies with an amount of the developer.

17. The image forming apparatus of claim 6, further comprising a controlling section that controls a whole operation of the developing apparatus, and wherein the light receiving section is installed on a substrate on which the controlling section is furnished.

* * * * *